US011610527B2

(12) United States Patent
Kim et al.

(10) Patent No.: US 11,610,527 B2
(45) Date of Patent: Mar. 21, 2023

(54) DATA PROCESSING DEVICE, DATA DRIVING DEVICE, AND SYSTEM FOR DRIVING DISPLAY DEVICE

(71) Applicant: SILICON WORKS CO., LTD., Daejeon (KR)

(72) Inventors: Do Seok Kim, Daejeon (KR); Yong Hwan Mun, Daejeon (KR); Myung Yu Kim, Daejeon (KR); Hyun Pyo Cho, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 7 days.

(21) Appl. No.: 17/235,068

(22) Filed: Apr. 20, 2021

(65) Prior Publication Data

US 2021/0343214 A1 Nov. 4, 2021

(30) Foreign Application Priority Data

Apr. 29, 2020 (KR) ..... 10-2020-0052575

(51) Int. Cl.
*G09G 3/20* (2006.01)

(52) U.S. Cl.
CPC ..... *G09G 3/20* (2013.01); *G09G 2310/08* (2013.01); *G09G 2370/04* (2013.01)

(58) Field of Classification Search
CPC ..... G09G 3/20; G09G 5/008; G09G 2310/08; G09G 2370/04
See application file for complete search history.

(56) References Cited

U.S. PATENT DOCUMENTS

| | | | | |
|---|---|---|---|---|
| 9,123,275 | B2 | 9/2015 | Yang et al. | |
| 2004/0221056 | A1* | 11/2004 | Kobayashi | H04L 5/1446 709/232 |
| 2005/0066085 | A1* | 3/2005 | Kobayashi | G06F 3/14 710/64 |
| 2007/0263713 | A1* | 11/2007 | Aronson | H04N 7/108 375/229 |
| 2014/0093233 | A1* | 4/2014 | Gao | H04B 10/0799 398/16 |

FOREIGN PATENT DOCUMENTS

| | | | |
|---|---|---|---|
| JP | 5269973 | B2 | 8/2013 |
| KR | 10-2013-0051182 | A | 5/2013 |
| KR | 10-2018-0033928 | A | 4/2018 |
| KR | 10-2020-0034863 | A | 4/2020 |

* cited by examiner

*Primary Examiner* — Shaheda A Abdin
(74) *Attorney, Agent, or Firm* — Rothwell, Figg, Ernst & Manbeck, P.C.

(57) ABSTRACT

The present disclosure relates to a data driving device, a data processing device, and a system for driving a display device and, more particularly, relates to a data driving device, a data processing device, and a system for automatically optimizing the configuration of the equalizer of the data driving device in the display device.

20 Claims, 8 Drawing Sheets

DATA PROCESSING DEVICE, DATA DRIVING DEVICE, AND SYSTEM FOR DRIVING DISPLAY DEVICE

CROSS REFERENCE TO RELATED APPLICATION

This application claims priority from Republic of Korea Patent Application No. 10-2020-0052575, filed on Apr. 29, 2020, which is hereby incorporated by reference in its entirety.

BACKGROUND

1. Field of Technology

The present disclosure relates to a technology for driving a display device.

2. Description of the Prior Art

In general, a display panel of a display device is configured as a plurality of pixels arranged in a matrix form, and each pixel includes subpixels such as R (red), G (green), and B (blue). In addition, the respective subpixels emit light in a grayscale according to image data and display an image on the display panel.

Here, the display device may include a data processing device called a "timing controller" and a data driving device called a "source driver", and image data is transmitted from the data processing device to the data driving device. The image data is transmitted as a digital signal, and the data driving device converts the image data received as a digital signal into an analog voltage and drives the respective pixels, that is, the display panel.

As described above, in order to drive the display panel, the data driving device must receive various types of signals from the data processing device.

Here, the data driving device may include an equalizer capable of enhancing signal reception performance by adjusting the signal received from the data processing device.

The equalizer of the data driving device is able to adjust the signal in various ways. For example, the equalizer may adjust the magnitude of the signal. Specifically, the equalizer may adjust the magnitude of the signal by multiplying the signal by a predetermined gain.

Here, if the gain of the equalizer is excessively small, the magnitude of the signal may be reduced. In this case, inter-symbol interference (ISI) and the like may occur, and thus signal reception performance of the data driving device may be degraded.

On the other hand, if the gain of the equalizer is excessively large, the noise component included in the signal may be amplified, which may degrade the signal reception performance of the data driving device.

As described above, if the gain of the equalizer is not appropriate, the signal reception performance of the data driving device is deteriorated. Thus, it is necessary to appropriately configure the gain at all times.

Conventionally, a configuration value for appropriately configuring the gain of an equalizer is manually determined by an engineer, or a specific configuration value is unilaterally transmitted from a signal transmission device (e.g., a data processing device or the like) and is then determined. However, such a conventional method may require excessive effort necessary for configuration of the equalizer, or may deteriorate the accuracy in configuring the equalizer.

SUMMARY OF THE INVENTION

In this background, in an aspect, the present disclosure provides a technique for automatically optimizing configuration of an equalizer of a data driving device in a display device.

To this end, in an aspect, the present disclosure provides a data driving device comprising: a communication circuit including an equalizer and configured to receive a first data signal containing a plurality of pieces of equalizer (EQ) configuration information for configuring the equalizer and then to receive an EQ training signal during a plurality of time sections; and a control circuit configured to evaluate reception performance for the EQ training signal of the communication circuit in each of the plurality of time sections by changing a configuration of the equalizer in every time section according to each piece of EQ configuration information and select optimal EQ configuration information according to a result of the evaluation.

The first data signal may further comprise information on the number of pieces of EQ configuration information, and the control circuit may identify the number of time sections through the information on the number of pieces of EQ configuration information.

The communication circuit may receive a first data signal through a low-speed data communication protocol, and may receive the EQ training signal through a high-speed data communication protocol, which is different from the low-speed data communication protocol.

The EQ training signal may include a training sequence that is repeated in every time section, and the training sequence may comprise a blank signal for distinguishing the respective time sections from each other, an EQ clock training signal disposed at the end of the blank signal, and an EQ test signal disposed at the end of the EQ clock training signal.

In a blank signal reception section of one training sequence, the communication circuit may initialize a clock trained in a training sequence prior to the one training sequence, and in an EQ clock training signal reception section of the one training sequence, the communication circuit may re-perform a clock training.

The first data signal and the EQ training signal may be transmitted from a data processing device and a level of a lock signal transmitted from the data driving device to the data processing device may is maintained to be constant when initializing the clock and re-performing the clock training.

The EQ test signal may include a pseudo random binary sequence (PRBS) pattern and the control circuit may calculate a bit error rate for the PRBS pattern in each time section and may select EQ configuration information corresponding to a time section having the minimum bit error rate among the plurality of time sections, as the optimal EQ configuration information.

The EQ test signal may include test data that is encoded in a DC balance code method and the control circuit may check whether there is any error in the test data in each time section and may select EQ configuration information, corresponding to a time section having the minimum number of errors in the test data among the plurality of time sections, as the optimal EQ configuration information.

The control circuit may change the configuration of the equalizer when the communication circuit receives the blank signal.

If a signal having a predetermined voltage level is received for a predetermined time or longer, the communication circuit may initialize a clock, and the blank signal may be maintained at a constant voltage level for a predetermined time.

In another aspect, the present disclosure provides a data driving device comprising: a communication circuit including an equalizer and configured to receive a first data signal containing a plurality of pieces of equalizer (EQ) configuration information for configuring the equalizer and then to receive an EQ training signal comprising a blank signal having a predetermined level, an EQ clock training signal disposed at the end of the blank signal, and an EQ test signal disposed at the end of the EQ clock training signal; and a control circuit configured to divide reception time of the EQ test signal into a plurality of time sections, when the communication circuit receives the EQ test signal, to evaluate reception performance for the EQ training signal of the communication circuit in each of the plurality of time sections by changing the configuration of the equalizer in each time section according to each piece of EQ configuration information, and to select optimal EQ configuration information according to a result of the evaluation.

The first data signal may further include information on the number of pieces of EQ configuration information, and the control circuit may determine the number of time sections to conform to the number of pieces of EQ configuration information.

Each of the plurality of pieces of EQ configuration information may include a gain level of the equalizer, and the control circuit may differently set the gain level of the equalizer in each time section according to each piece of EQ configuration information.

In still another aspect, the present disclosure provides a system comprising: a data processing device configured to generate a first data signal comprising a plurality of pieces of equalizer (EQ) configuration information, which is configuration information of an equalizer, to transmit the first data signal, to generate an EQ training signal, and to transmit the EQ training signal during a plurality of time sections; and a data driving device comprising the equalizer and configured to receive the EQ training signal during the plurality of time sections after receiving the first data signal, to evaluate reception performance for the EQ training signal by changing a configuration of the equalizer in each of the plurality of time sections according to each piece of EQ configuration information, to select optimal EQ configuration information according to a result of the evaluation, and then, to configure the equalizer according to the optimal EQ configuration information.

The data processing device may transmit a first data signal to the data driving device through a low-speed data communication protocol and may transmit the EQ training signal to the data driving device through a high-speed data communication protocol, which is different from the low-speed data communication protocol.

The data processing device may transmit a communication signal, having a communication frequency corresponding to the high-speed data communication protocol, to the data driving device before transmitting the EQ training signal, and the data driving device may receive the communication signal, may train a clock included in the communication signal by changing a configuration value of an oscillator included in an internal circuit every predetermined time, and may determine an optimal configuration value for the communication frequency according to a result of training the clock.

The configuration value may include any one of a reference current value, a reference voltage value, and a gain of the oscillator.

The EQ training signal may include a training sequence that is repeated in each time section, and the training sequence may comprise a blank signal for distinguishing the respective time sections from each other, an EQ clock training signal disposed at the end of the blank signal, and an EQ test signal disposed at the end of the EQ clock training signal. In a blank signal reception section of one training sequence, the data driving device may initialize a clock trained in a training sequence prior to the one training sequence, and in an EQ clock training signal reception section of the one training sequence, the data driving device may re-perform a clock training.

The data driving device may initialize a clock if a signal having a predetermined voltage level is received for a predetermined time or longer.

The data driving device may receive a signal having a predetermined voltage level for a predetermined time or longer in each time section to initialize a clock.

In still another aspect, the present disclosure provides a data processing device including: a control circuit storing a plurality of pieces of equalizer (EQ) configuration information; and a communication circuit configured to generate a first data signal including the plurality of pieces of EQ configuration information, to transmit the first data signal through a second communication protocol, and to transmit an EQ training signal to a data driving device through a first communication protocol, which is different from the second communication protocol, after generating the EQ training signal for an equalizer of the data driving device.

The EQ training signal may include a training sequence that is repeated in each time section and the training sequence may comprise a blank signal for distinguishing the respective time sections from each other, an EQ clock training signal disposed at the end of the blank signal, and an EQ test signal disposed at the end of the EQ clock training signal.

The EQ training signal may comprise a blank signal having a predetermined level, an EQ clock training signal disposed at the end of the blank signal, and an EQ test signal disposed at the end of the EQ clock training signal.

As described above, according to the present disclosure, since the data driving device is able to automatically optimize the configuration of the equalizer, it is possible to improve the accuracy in configuration of the equalizer and to efficiently perform configuration of the equalizer.

DETAILED DESCRIPTION OF THE EXEMPLARY EMBODIMENTS

Figure 1:
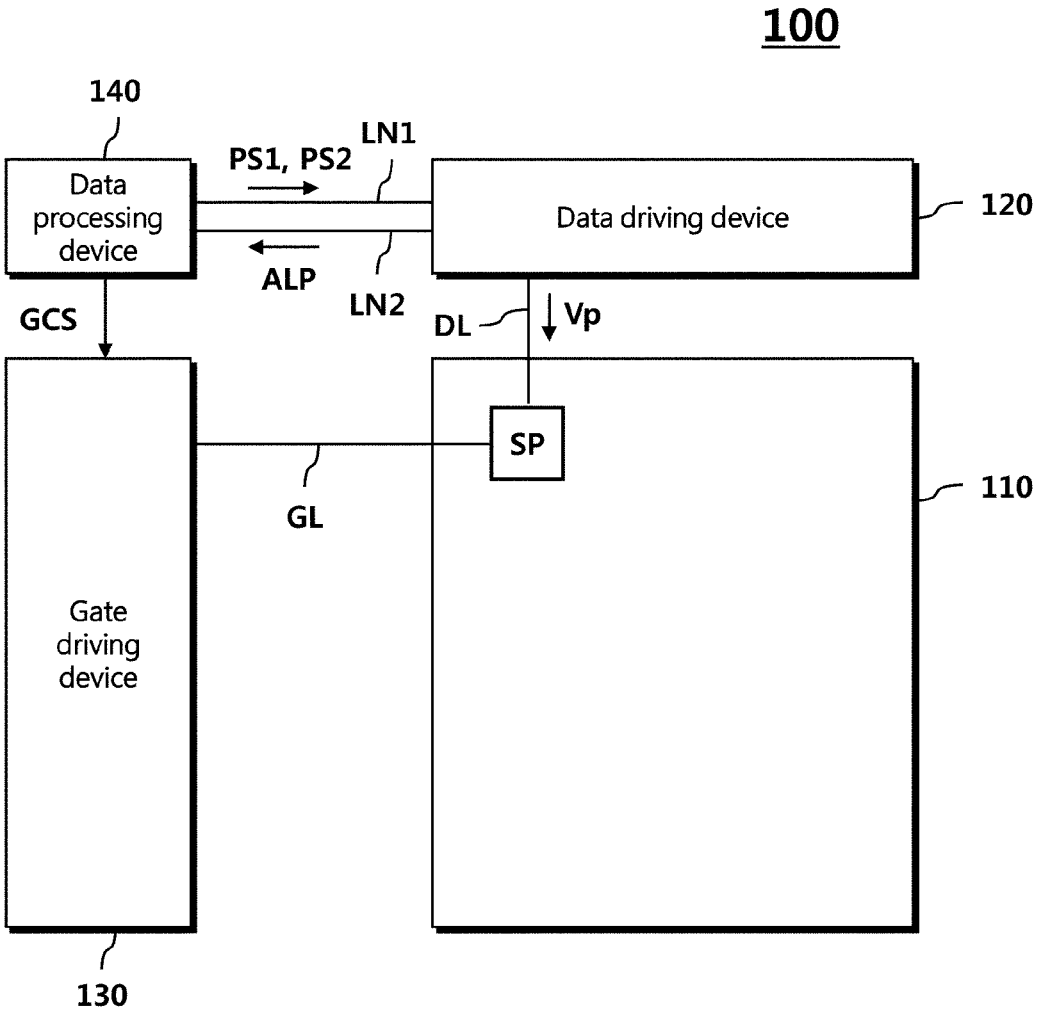
FIG. 1 is a diagram illustrating the configuration of a display device according to an embodiment.

FIG. 1 is a diagram illustrating the configuration of a display device according to an embodiment.

Referring to FIG. 1, a display device 100 may include a display panel 110, a data driving device 120, a gate driving device 130, a data processing device 140, and the like.

A plurality of data lines DL and a plurality of gate lines GL may be arranged on the display panel 110, and a plurality of pixels may be arranged thereon. The pixel may include a plurality of subpixels SP. Here, the subpixels may be R (red), G (green), B (blue), W (white), and the like. One pixel may be configured as subpixels SP of RGB, subpixels SP of RGBG, subpixels SP of RGBW, or the like. Hereinafter, a description will be made based on the case where one pixel includes subpixels of RGB for convenience of description.

The data driving device 120, the gate driving device 130, and the data processing device 140 are devices that generate signals for displaying an image on the display panel 110.

The gate driving device 130 may supply a gate driving signal having a turn-on voltage or a turn-off voltage to the gate line GL. When a gate driving signal of a turn-on voltage is supplied to the subpixel SP, the subpixel SP is connected to the data line DL. In addition, when a gate driving signal of a turn-off voltage is supplied to the subpixel SP, the connection between the subpixel SP and the data line DL is released. The gate driving device 130 may be referred to as a "gate driver".

The data driving device 120 may supply a data voltage Vp to the subpixel SP through the data line DL. The data voltage Vp supplied to the data line DL may be supplied to the subpixel SP according to the gate driving signal. The data driving device 120 may be referred to as a "source driver".

The data driving device 120 may include at least one integrated circuit, and the at least one integrated circuit may be connected to a bonding pad of the panel 110 by a tape-automated-bonding (TAB) type or a chip-on-glass (COG) type, or may be formed directly on the panel 110, and according to the embodiment, the integrated circuit may be formed by being integrated on the panel 110. In addition, the data driving device 120 may be implemented by a chip-on-film (COF) type.

The data processing device 140 may supply control signals to the gate driving device 130 and the data driving device 120. For example, the data processing device 140 may transmit a gate control signal GCS for starting scanning to the gate driving device 130. In addition, the data processing device 140 may output image data to the data driving device 120. In addition, the data processing device 140 may transmit a data control signal for controlling the data driving device 120 to supply the data voltage Vp to each subpixel SP. The data processing device 140 may be referred to as a "timing controller".

Figure 2:
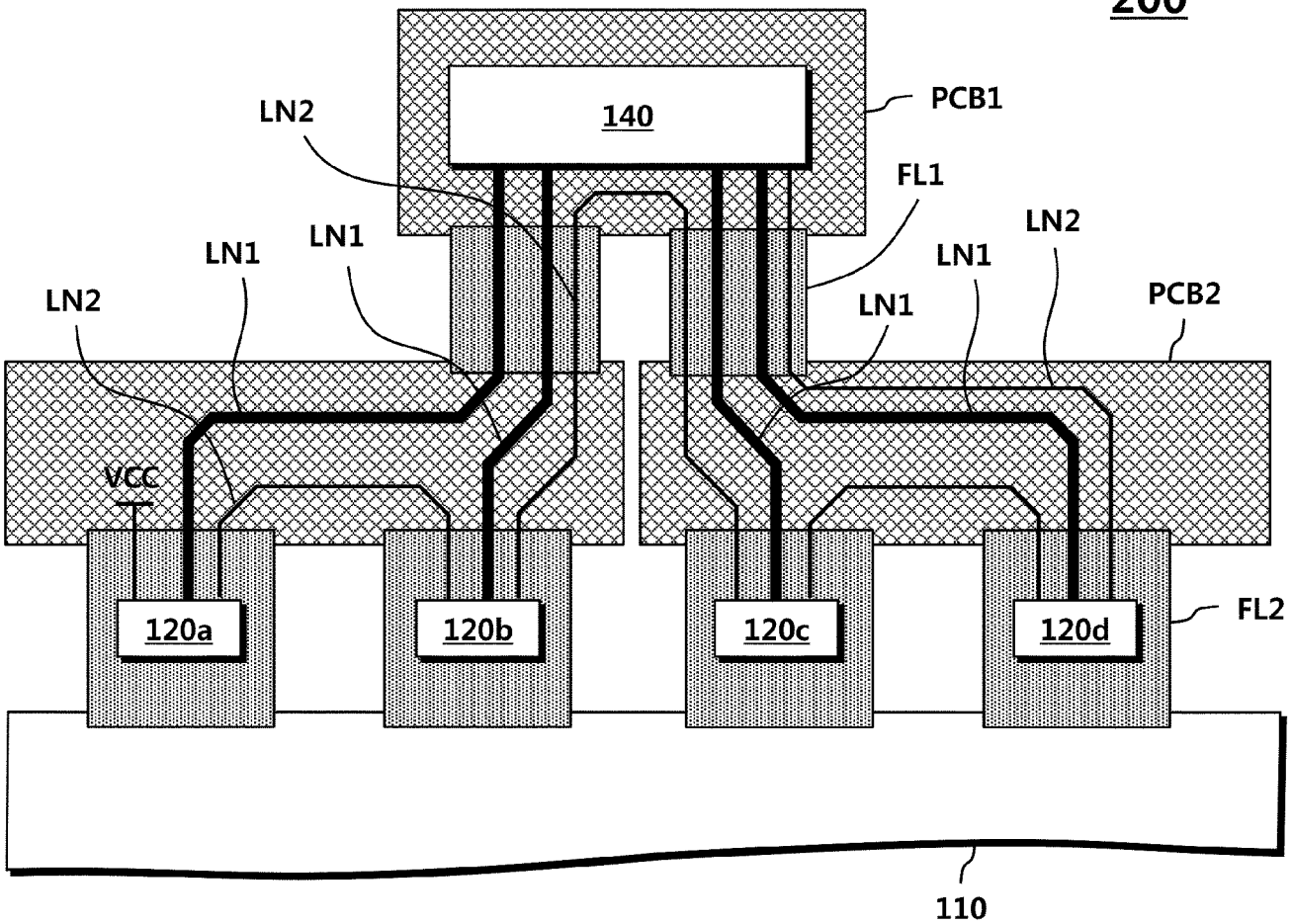
FIGS. 2 and 3 are diagrams illustrating the configuration of a system according to an embodiment.

FIG. 2 is a diagram illustrating the configuration of a system according to an embodiment.

Referring to FIG. 2, the system may include at least one data processing device 140 and a plurality of data driving devices 120*a*, 120*b*, 120*c*, and 120*d*.

The data processing device 140 may be disposed on a first printed circuit board (PCB) PCB1. In addition, the data processing device 140 may be connected to the plurality of data driving devices 120*a*, 120*b*, 120*c*, and 120*d* through first communication lines LN1 and second communication lines LN2.

The first communication lines LN1 and the second communication lines LN2 may lead to the plurality of data driving devices 120*a*, 120*b*, 120*c*, and 120*d* via the first PCB PCB1 and the second PCB PCB2. The first PCB PCB1 and the second PCB PCB2 may be connected by a first film FL1, which is made of a flexible material, and the first communication lines LN1 and the second communication lines LN2 may extend from the first PCB PCB1 to the second PCB PCB2 through the first film FL1.

Each of the data driving devices 120*a*, 120*b*, 120*c*, and 120*d* may be disposed in the form of a chip-on-film (COF) on the second film FL2. The second film FL2 may be a support substrate made of a flexible material that connects the second PCB PCB2 with the panel 110, and the first communication lines LN1 and the second communication lines LN2 may extend through the second film FL2 to each of the data driving devices 120*a*, 120*b*, 120*c*, and 120*d* on the second PCB PCB2.

The first communication line LN1 may connect the data processing device 140 and the data driving devices 120*a*, 120*b*, 120*c*, and 120*d* one-to-one.

In addition, the second communication line LN2 may connect the data driving devices 120*a*, 120*b*, 120*c*, and 120*d* to each other, or may connect the data driving device 120*d* to the data processing device 140 without overlapping the first communication lines LN1 on the plane. For example, the first data driving device 120*a* may be connected to the second data driving device 120*b* through the second communication line LN2, and the second data driving device 120*b* may be connected to the third data driving device 120*c* through the second communication line LN2. In this case, the second data driving device 120*b* and the third data driving device 120*c* may be connected to different second PCBs PCB2 from each other. Accordingly, the second communication line LN2 disposed therebetween may pass through the second PCB PCB2, the first film FL1, and the first PCB PCB1, thereby connecting the second data driving device 120*b* and the third data driving device 120*c*. The third data driving device 120*c* may be connected to the fourth data driving device 120*d* through the second communication line LN2, and the fourth data driving device 120*d* may be connected to the data processing device 140 through the second communication line LN2.

As described above, the data processing device 140 and the data driving devices 120*a*, 120*b*, 120*c*, and 120*d* may communicate with each other through the first communication lines LN1 and the second communication lines LN2.

Here, the data processing device 140 may transmit image data to the data driving devices 120*a*, 120*b*, 120*c*, and 120*d* through the first communication lines LN1.

In an embodiment, the data driving devices 120*a*, 120*b*, 120*c*, and 120*d* may automatically optimize the configuration of an equalizer using signals transmitted from the data processing device 140 before receiving image data from the data processing device 140.

Figure 3:
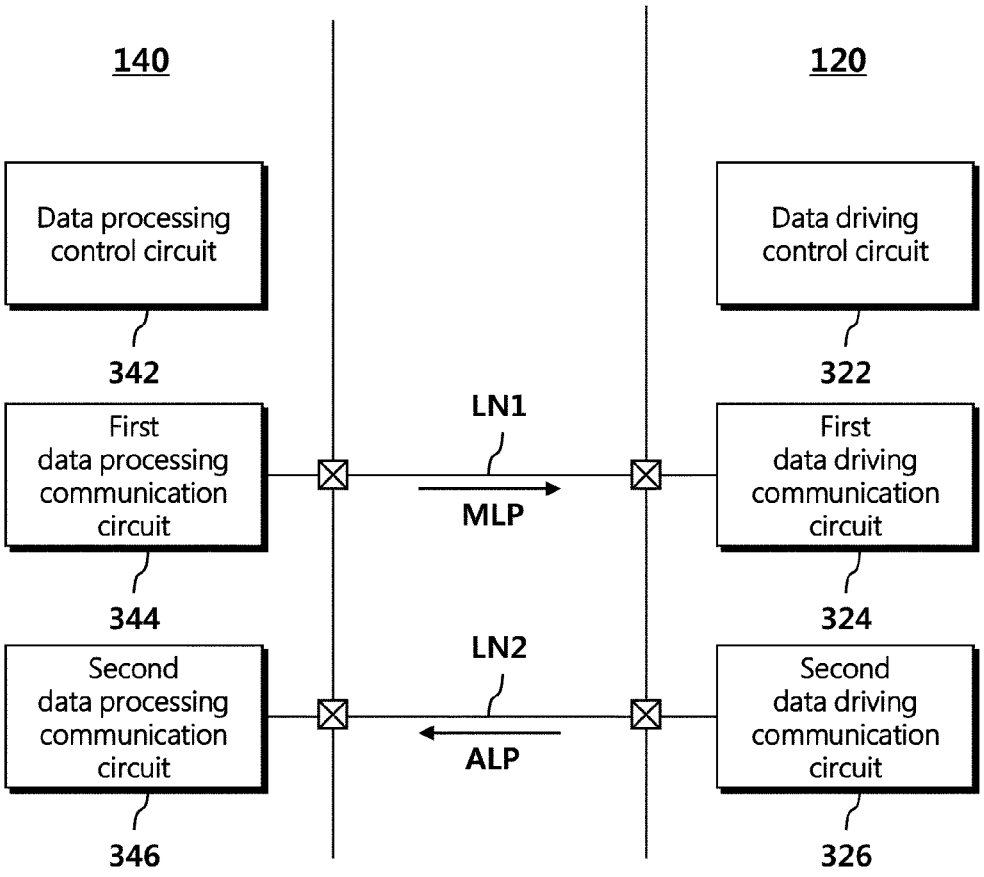

Meanwhile, the data processing device 140 may include a data processing control circuit 342, a first data processing communication circuit 344, and a second data processing communication circuit 346 as shown in FIG. 3.

In addition, the data driving device 120 may include a data driving control circuit 322, a first data driving communication circuit 324, and a second data driving communication circuit 326.

The first data processing communication circuit 344 and the first data driving communication circuit 324 may be connected through a first communication line LN1. In addition, the first data processing communication circuit 344 may transmit a main communication signal MLP to the first data driving communication circuit 324 through the first communication line LN1.

The second data processing communication circuit 346 and the second data driving communication circuit 326 may be connected through a second communication line LN2. In addition, the second data driving communication circuit 326 may transmit an auxiliary communication signal ALP to the second data processing communication circuit 346 through the second communication line LN2.

Figure 4:
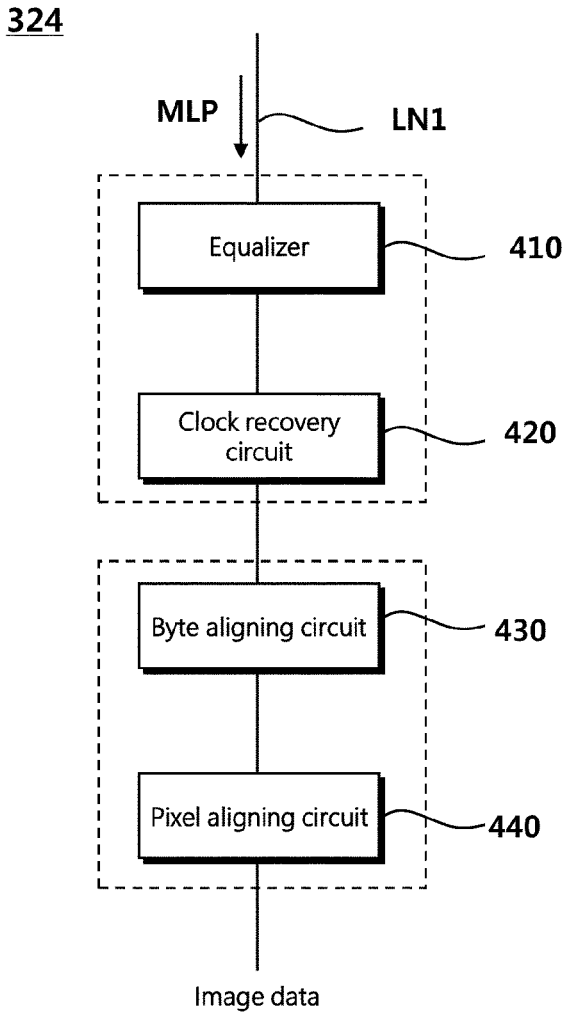
FIG. 4 is a diagram illustrating the configuration of a first data driving communication circuit according to an embodiment.

FIG. 4 is a diagram illustrating the configuration of a first data driving communication circuit according to an embodiment.

Referring to FIG. 4, the first data driving communication circuit 324, that is, the first communication circuit 324 of the data driving device 120 may include an equalizer 410, a clock recovery circuit 420, a byte aligning circuit 430, and a pixel aligning circuit 440.

The equalizer 410 may be connected to the first communication line LN1, and may control a main communication signal MLP received through the first communication line LN1.

Specifically, distortion may occur in the main communication signal MLP when the signal passes through the first communication line LN1, which may cause attenuation (or pulse dispersion) of a high-frequency component of the main communication signal MLP, inter-symbol interference (ISI) therein, and the like. The equalizer 410 may reproduce a high-frequency component in the main communication signal MLP in which the distortion has occurred (or may remove pulse dispersion therefrom), thereby reducing inter-symbol interference.

The equalizer 410 may transmit the adjusted main communication signal MLP to the clock recovery circuit 420, the byte aligning circuit 430, the pixel aligning circuit 440, and/or the like, thereby strengthening reception performance of the first communication circuit 224.

The equalizer 410 may adjust the main communication signal MLP according to the configuration.

For example, the equalizer 410 may determine the amount of amplification in the main communication signal MLP according to a configured gain. In other words, a configuration value for configuring the equalizer 410 may include a gain level for configuring the gain of the equalizer 410.

The configuration value of the equalizer 410 may be stored in the data processing device 140.

In addition, when applying power to the display device 100, the configuration value of the equalizer 410 and the like may be transmitted to the first data driving communication circuit 324 of the data driving device 120 through the first data processing communication circuit 344 of the data processing device 140.

The clock recovery circuit 420 may receive a clock pattern through the main communication signal MLP, and may perform clock training according to the clock pattern. In this case, clock training performance of the clock recovery circuit 420 may be affected by the adjustment of the main communication signal MLP by the equalizer 410.

The byte aligning circuit 430 and the pixel aligning circuit 440 may train link clock such as symbol clock, pixel clock, and the like according to the link data, and may align image data in units of bytes (e.g., in units of symbols) according to the link clock, and may align the same in units of pixels. Here, the link training performance or link recovery performance of the byte aligning circuit 430 and the pixel aligning circuit 440 may also be affected by the adjustment of the main communication signal MLP by the equalizer 410.

As described above, the reception performance of the first data driving communication circuit 324, that is, the clock training performance of the clock recovery circuit 420, and the link training performance or link recovery performance of the byte aligning circuit 430 and the pixel aligning circuit 440 may be influenced by the configuration of the equalizer 410.

Here, the main communication signal MLP received by the equalizer 410 through the first communication line LN1 may have distortion, which occurs therein, depending on the characteristics of the first communication line LN1.

In addition, the characteristics of the first communication line LN1 may be frequently changed due to the surrounding environment (e.g., an increase in temperature inside the display device 100, static electricity, etc.), physical deterioration of the first communication line LN1, and the like. Accordingly, the signal distortion form in the main communication signal MLP may also be frequently changed.

If the signal distortion form in the main communication signal MLP is frequently changed as described above, the configuration of the equalizer 410 must also be frequently changed so as to conform to the changed signal distortion form.

With regard this, in an embodiment, the configuration of the equalizer 410 may be automated through the following configuration.

Figure 5:
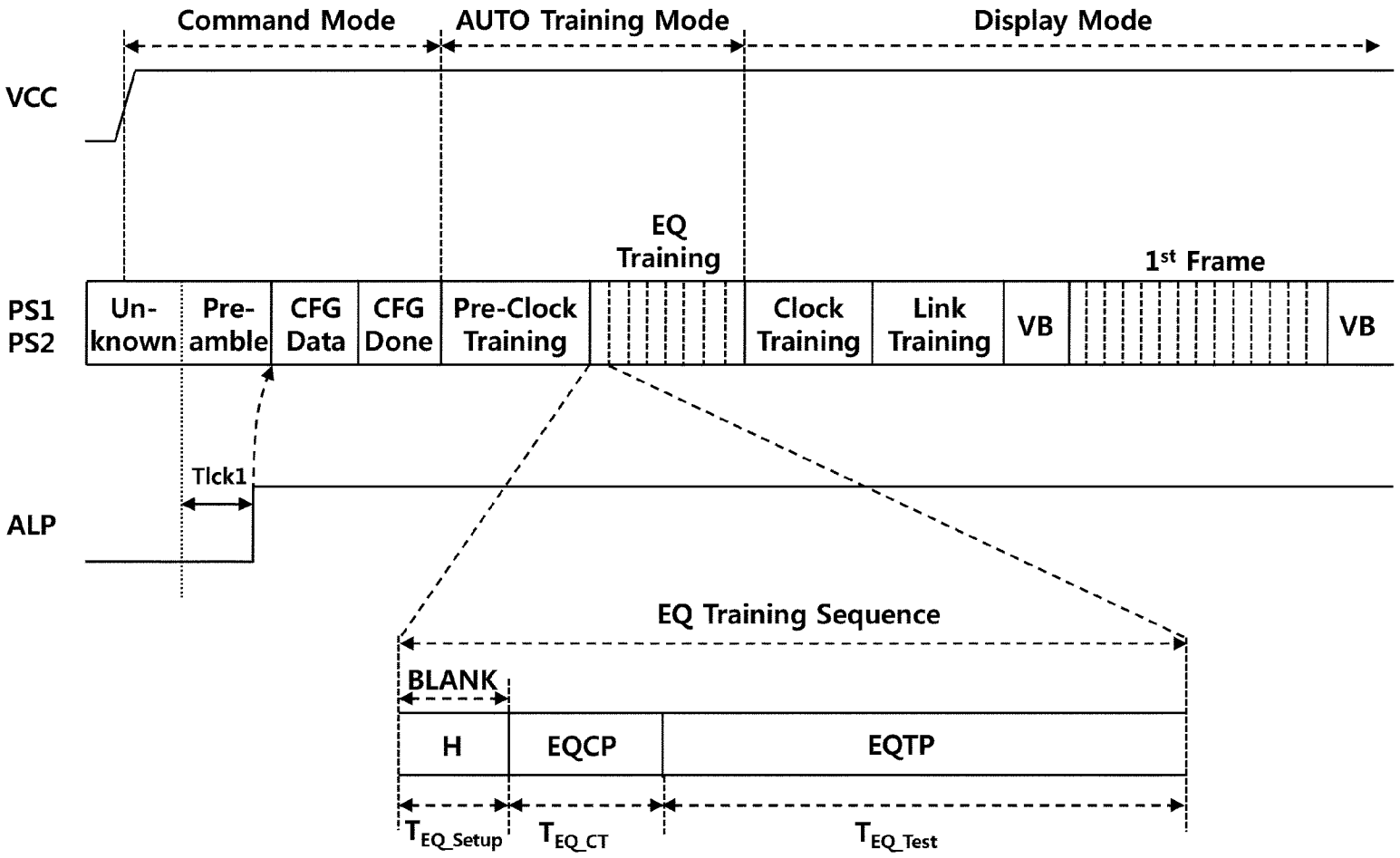
FIGS. 5 and 6 are diagrams illustrating a signal sequence for configuring an equalizer of a first data driving communication circuit according to an embodiment.
Figure 6:
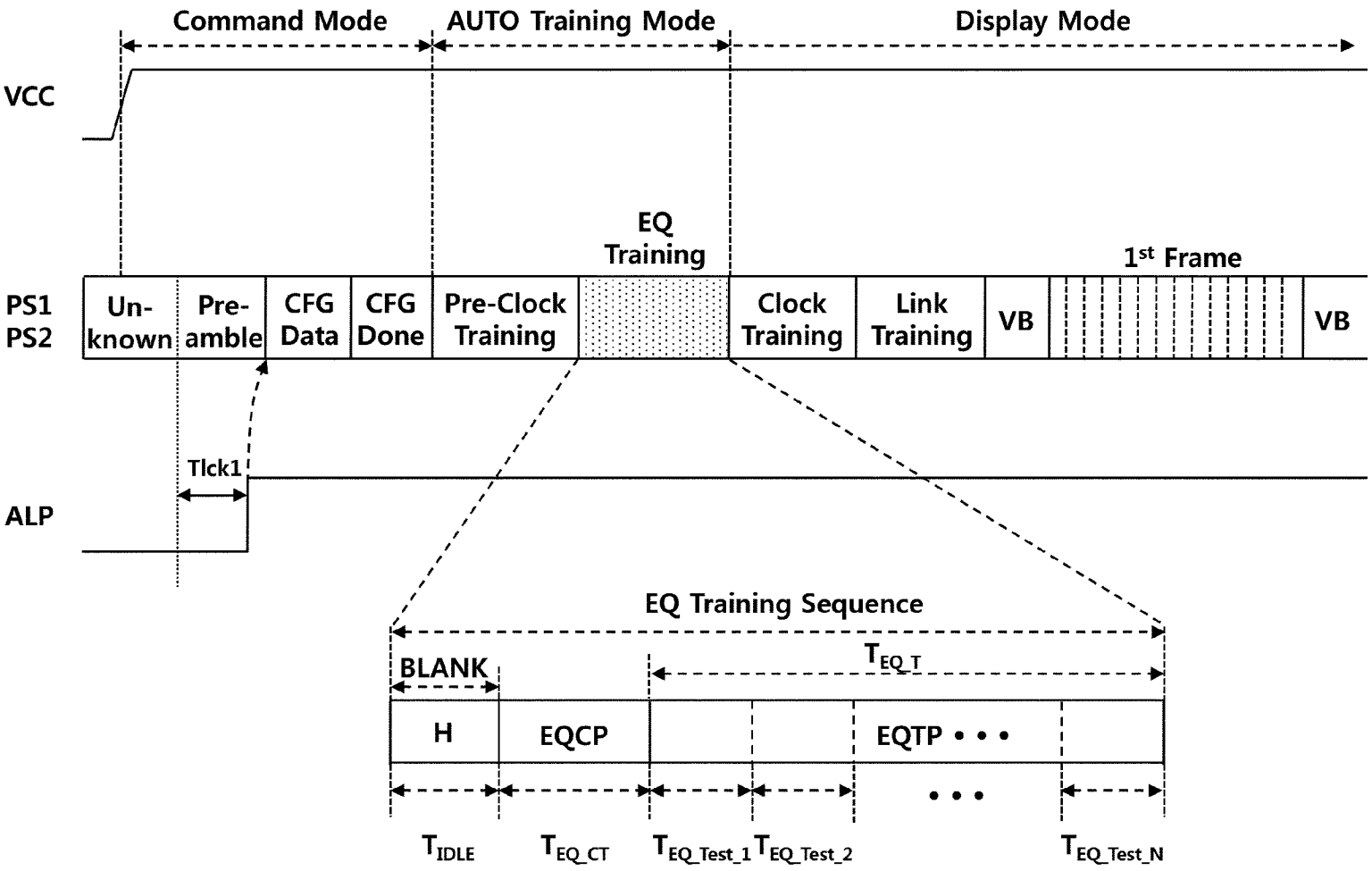

FIGS. 5 and 6 are diagrams illustrating a signal sequence for configuration of an equalizer in a first communication circuit according to an embodiment.

First, referring to FIG. 5, when a driving voltage VCC is supplied to the data processing device 140 and the data driving device 120, the first data processing communication circuit 344 of the data processing device 140 may transmit a second protocol signal PS2 to the first data driving communication circuit 324 of the data driving device 120 within a predetermined time (for example, in a command mode in FIG. 5).

After transmitting the second protocol signal PS2, the first data processing communication circuit 344 may transmit a first protocol signal PS1. For example, the first data processing communication circuit 344 may transmit a first protocol signal PS1 in an AUTO training mode in FIG. 5.

Here, the second protocol signal PS2 or the first protocol signal PS1 is a kind of main communication signal MLP that is transmitted through the first communication line LN1, and may be based on the second communication protocol and the first communication protocol regulated between the data processing device 140 and the data driving device 120.

In addition, the communication frequency of the first protocol signal PS1 may be 10 times the communication frequency of the second protocol signal PS2 or more. According to this characteristic, the first protocol signal PS1 may be classified as a high-speed data communication protocol, and the second protocol signal PS2 may be classified as a low-speed data communication protocol.

Since high-speed data communication may have a higher data loss rate than low-speed data communication, the first data processing communication circuit 344 may transmit, to the first data driving communication circuit 324, a variety of configuration information of the data driving device 120, which is necessary for high-speed data communication, through the second protocol signal PS2.

In other words, the data processing device 140 may transmit a variety of configuration information of the data driving device 120, which is necessary for high-speed data communication, to the data driving device 120 through low-speed data communication having a low data loss rate, thereby enabling accurate reception of the configuration information by the data driving device 120.

In an embodiment, the data processing control circuit 342 of the data processing device 140 may store a plurality of pieces of equalizer (EQ) configuration information, and may control the first data processing communication circuit 344. Here, the values of the plurality of pieces of EQ configuration information may be determined through a number of experiments on signal distortion of the main communication signal MLP, which is frequently changed.

The first data processing communication circuit 344 may generate a second protocol signal PS2 including a plurality of pieces of EQ configuration information under the control of the data processing control circuit 342.

In addition, the first data processing communication circuit 344 may transmit a second protocol signal PS2 including a plurality of pieces of EQ configuration information to the first data driving communication circuit 324 in a CFG data section in FIG. 5. Hereinafter, the second protocol signal PS2 including a plurality of pieces of EQ configuration information will be referred to as a "first data signal".

In an embodiment, the plurality of pieces of EQ configuration information may include gain levels of the equalizer 410, which are different from each other. For example, in the case where the plurality of pieces of EQ configuration information is first EQ configuration information and second EQ configuration information, the first EQ configuration information may include a first gain level, and the second EQ configuration information may include a second gain level, which is different from the first gain level. Each of the plurality of pieces of EQ configuration information may further include a tap coefficient of the equalizer 410.

Meanwhile, the first data driving communication circuit 324 connected to the first data processing communication circuit 344 through the first communication line LN1 may receive a first data signal through the second communication protocol. In addition, the data driving control circuit 322 may store the plurality of pieces of EQ configuration information in an auxiliary storage medium (e.g., a register or the like).

Here, the first data signal may further include information on the number of pieces of EQ configuration information in addition to the plurality of pieces of EQ configuration information. For example, in the case where there are 8 pieces of EQ configuration information, the information on the number thereof may be "8". In addition, the first data signal may further include default EQ configuration information, scramble information, line polarity information, and the like.

The data driving control circuit 322 may further store information on the number of pieces of EQ configuration information in the auxiliary storage medium, and may configure the equalizer 410 as default using the first data signal. In addition, other circuit parts for high-speed data communication may be configured. Here, the default EQ configuration information may include a default gain level of the equalizer 410 for high-speed data communication, and the scramble information may include information indicating whether or not data is scrambled when the data processing device 140 transmits the data to the data driving device 120. In addition, the line polarity information may include information indicating the polarity of the first line in the pixel.

Meanwhile, after the transmission and reception of the first data signal is completed, that is, after the CFG data section ends, the first data processing communication circuit 344 may transmit a second protocol signal PS2 including an end message to the first data driving communication circuit 324 under the control of the data processing control circuit 342 in the CFG done section. Here, the end message may be a message indicating termination of the communication for the second protocol signal PS2, and the data driving control circuit 322 may identify the end message in the second protocol signal PS2 received from the first data driving communication circuit 324, and may terminate the communication according to the second protocol (low-speed data communication protocol).

Meanwhile, the second protocol signal PS2 may include a low-speed data communication clock signal in a preamble section prior to the CFG data section, and the data driving device 120, that is, the first data driving communication circuit 324 may perform training of the clock for low-speed data communication using the low-speed data communication clock signal.

Here, the auxiliary communication signal ALP may be maintained at a low level until the clock training for the low-speed data communication clock is completed, and may be changed to a high level when the clock training is completed. In other words, after the driving voltage VCC is supplied, the second data driving communication circuit 326 may maintain the auxiliary communication signal ALP at a low level under the control of the data driving control circuit 322, and may switch the same to a high level when the clock training for the low-speed data communication clock is completed in the preamble section. In addition, the first data processing communication circuit 344 may transmit the first data signal after the auxiliary communication signal ALP is changed to a high level. Here, the auxiliary communication signal ALP may be referred to as a "lock signal", and may be transmitted to the second data processing communication circuit 346 through the second communication line LN2 in FIG. 2.

If there is an abnormality in the internal state, or if an unscheduled communication error occurs after changing the auxiliary communication signal ALP to a high level, the data driving control circuit 322 may change the auxiliary communication signal ALP into a low level. For example, if a signal fails to be received or the clock is spoiled in the CFG data section or the CFG done section, the data driving device 120 may change the auxiliary communication signal ALP into a low level.

After the low-speed data communication between the data processing device 140 and the data driving device 120 is terminated as described above, the first data processing communication circuit 344 may generate an EQ training signal, which is a first protocol signal, and may transmit the EQ training signal to the first data driving communication circuit 324 through the first communication line LN1. Here, the first data processing communication circuit 344 may transmit the EQ training signal during a plurality of time sections (EQ training sections).

In an embodiment, the EQ training signal may include a training sequence that is repeated every time section as shown in FIG. 5. In addition, the training sequence may be configured as a blank signal H having a predetermined level (e.g., a high level), an EQ clock training signal EQCP disposed at the end of the blank signal, and an EQ test signal EQTP disposed at the end of the EQ clock training signal EQCP. Here, the blank signal H may be a signal for distinguishing from the respective time sections.

The EQ test signal EQTP may include a pseudo random binary sequence (PRBS) pattern. Here, the PRBS pattern may be implemented as a PRBS7 pattern, a PRBS9 pattern, a PRBS10 pattern, and the like.

The EQ test signal EQTP may include test data that is encoded by a DC balance code method. Here, the test data encoded by the DC balance code method may include a plurality of code groups having the same number of "0"s and "1" s.

The first data driving communication circuit 324 may receive the EQ training signal during a plurality of time sections. Here, the EQ training signal may have distortion therein while passing through the first communication line LN1.

When the first data driving communication circuit 324 receives the EQ training signal, the data driving control circuit 322 may change the configuration of the equalizer 410 every time section according to a plurality of pieces of EQ configuration information during a plurality of time sections. Here, the data driving control circuit 322 may evaluate the reception performance of the first data driving communication circuit 324 for the EQ training signal by changing the configuration of the equalizer 410 for each of the plurality of time sections.

In addition, optimal configuration information may be selected from among the plurality of pieces of EQ configuration information according to the evaluation result for each time section.

For example, if there are N time sections (where N is a natural number), and if the EQ training signal includes the first training sequence to the $N^{th}$ training sequence, the first data driving communication circuit 324 may receive the first training sequence in the first time section. In this case, in a section $T_{EQ_Setup}$ in which the first data driving communication circuit 324 receives a blank signal H of the first training sequence, the data driving control circuit 322 may configure the equalizer 410 using first EQ configuration information among the plurality of pieces of EQ configuration information.

Thereafter, the first data driving communication circuit 324 may perform clock training for testing the equalizer 410 in a section $T_{EQ_CT}$ in which an EQ clock training signal EQCP of the first training sequence is received. Here, clock training may be performed by the clock recovery circuit 420.

The first data driving communication circuit 324, having recovered the clock through the clock training, may receive the EQ test signal EQTP through the equalizer 410 configured using the first EQ configuration information, and may recover data in the EQ test signal EQTP. Here, data recovery may be performed by the byte aligning circuit 430 and the pixel aligning circuit 440.

If the EQ test signal EQTP includes a PRBS pattern, the data driving control circuit 322 may check whether or not the PRBS pattern included in the recovered data matches a previously stored bit stream during a reception time $T_{EQ_Test}$ of the EQ test signal EQTP, and may identify a bit error rate for the EQ test signal EQTP according thereto.

If the EQ test signal EQTP includes test data that is encoded in a DC balance code method, the data driving control circuit 322 may identify the number of "0"s and "1"s in the code group of the recovered data during the reception time $T_{EQ_Test}$ of the EQ test signal EQTP, and may identify whether or not there is a data error in the EQ test signal EQTP according thereto. Here, the DC balance code method may be an 8B10B encoding/decoding method.

The data driving control circuit 322 may evaluate the reception performance of the first data driving communication circuit 324 for the first EQ configuration information through the bit error rate of the EQ test signal or the information on whether or not there is a data error therein as described above.

After the first training sequence is completed, the first data driving communication circuit 324 may receive the second training sequence in the second time interval.

When the first data driving communication circuit 324 receives a blank signal H of the second training sequence, the data driving control circuit 322 may recognize that the second time section starts, and may configure the equalizer 410 using the second EQ configuration information among the plurality of pieces of EQ configuration information. In other words, the equalizer 410 configured as the first EQ configuration information may be changed so as to be configured as the second EQ configuration information.

The first data driving communication circuit 324 may initialize the clock recovered in the first training sequence in a blank signal reception section of the second training sequence.

Thereafter, the first data driving communication circuit 324 and the data driving control circuit 322 may perform clock retraining using the EQ clock training signal and the EQ test signal of the second training sequence, and evaluation of reception performance of the first data driving communication circuit 324.

If the clock is initialized by the blank signal H in each training sequence as described above, the clock recovery performance may be equal in the respective training sequences, so the evaluation of reception performance of the first data driving communication circuit 324 may be performed more accurately.

Meanwhile, when performing the clock initialization and the clock retraining by the first data driving communication circuit 324, the lock signal transmitted from the second data driving communication circuit 326 to the second data processing communication circuit 346 may be maintained at the existing level (e.g., a high level).

In general, when the clock is initialized by the first data driving communication circuit 324, the lock signal is changed from a high level to a low level. Here, if the clock initialization and the clock retraining are performed for each of the plurality of time sections as described above, the level of the lock signal must also be changed for each time section. In this case, a frequent change in the level of the lock signal may increase the possibility of an error occurring in transmission of the lock signal. Therefore, in an embodiment, the level of the lock signal may be maintained at the existing level (e.g., a high level) regardless of the clock initialization and the clock retraining described above, thereby reducing the possibility of an error occurring in transmission of the lock signal.

The data driving control circuit 322 may evaluate the reception performance of the first data driving communication circuit 324 for each of the plurality of pieces of EQ configuration information by repeatedly performing the above-described process for each of the plurality of time sections.

In addition, the data driving control circuit 322 may select EQ configuration information enabling optimal reception performance, as optimal EQ configuration information, from among the plurality of pieces of EQ configuration information, and may complete the configuration of the equalizer 410 according to the optimal EQ configuration information.

The data driving control circuit 322 may identify the number of time sections through information on the number of pieces of EQ configuration information, which is previously stored. In other words, the data driving control circuit 322 may i the number of repetitions of the training sequences included in the EQ training signal through the information on the number of pieces of EQ configuration information.

For example, if the information on the number of pieces of EQ configuration information is "8", the data driving control circuit 322 may recognize the number of time sections, that is, may recognize that the training sequence shown in FIG. 5 is repeated eight times. Accordingly, the data driving control circuit 322 may change the configuration of the equalizer 410 for each of 8 time sections according to a plurality of pieces of EQ configuration information, and may then terminate the operation of changing the configuration of the equalizer 410.

In the case where the EQ test signal EQTP includes a PRBS pattern, the data driving control circuit 322 may select, as optimal EQ configuration information, EQ configuration information corresponding to the time section having the minimum bit error rate from among the plurality of time sections.

In the case where the EQ test signal EQTP includes test data that is encoded by a DC balance code method, the data driving control circuit 322 may select, as optimal EQ configuration information, EQ configuration information corresponding to the time section having the minimum number of errors occurring in the test data from among the plurality of time sections.

As described above, when the data driving device 120 completes the configuration of the equalizer 410 according to the optimal EQ configuration information, the data processing control circuit 342 may process image data, and may transmit the image data to the first data driving communication circuit 324 through the first data processing communication circuit 344.

In other words, the data processing device 140 and the data driving device 120 may perform communication (display mode) to receive the image data.

In the above, the configuration including the training sequence in which the EQ training signal is repeated every time section, that is, the configuration in which a blank signal, an EQ training signal, and an EQ test signal are repeated every time section has been described.

Hereinafter, the configuration in which an EQ training signal includes one blank signal, one EQ clock training signal, and one EQ test signal will be described.

Referring to FIG. 6, as described above, after the low-speed data communication between the data processing device 140 and the data driving device 120 is terminated, the first data processing communication circuit 344 may generate an EQ training signal, which is a first protocol signal, and may transmit the EQ training signal to the first data driving communication circuit 324 through a first communication line LN1. Here, the first data processing communication circuit 344 may transmit the EQ training signal during a plurality of time sections (EQ training sections).

In an embodiment, the EQ training signal may be configured as a blank signal H having a predetermined level (e.g., a high level), an EQ clock training signal EQCP disposed at the end of the blank signal H, and an EQ test signal EQTP disposed at the end of the EQ clock training signal EQCP as shown in FIG. 6.

In FIG. 5, the EQ training signal has a pattern in which the blank signal H, the EQ clock training signal EQCP, and the EQ test signal EQTP are repeated for each of a plurality of time sections, whereas in FIG. 6, the EQ training signal may be configured such that the blank signal H lasts for a first time $T_{IDLE}$, then the EQ clock training signal EQCP lasts for a second time $T_{EQ_CT}$, and the EQ test signal EQTP lasts for a third time $T_{EQ_T}$.

In other words, in an embodiment, the EQ training signal may have a pattern including one EQ training sequence, instead of a pattern in which the EQ training sequence is repeated every time section.

Here, the third time $T_{EQ_TEST_1}$ to $T_{EQ_TEST_N}$ may be longer than the first time $T_{IDLE}$ and the second time $T_{EQ_CT}$.

The EQ test signal EQTP may also include a pseudo random binary sequence (PRBS) pattern in FIG. 6.

In addition, the EQ test signal EQTP may include test data that is encoded by a DC balance code method.

Meanwhile, when the first data driving communication circuit 324 receives the EQ training signal, the data driving control circuit 322 may change the configuration of the equalizer 410 according to a plurality of pieces of EQ configuration information at or after the time at which the third time $T_{EQ_T}$ starts. Here, the data driving control circuit 322 may store unit time section information, and may determine the third time in advance by multiplying information on the number of pieces of EQ configuration information by the unit time section information.

In addition, the data driving control circuit 322 may subdivide the third time into a plurality of time sections.

For example, if the information on the number of pieces of EQ configuration information is "8", and if the unit time section information is 5 ms, the data driving control circuit 322 may determine the third time to be 40 ms.

In addition, the data driving control circuit 322 may subdivide the third time into eight time sections.

Thereafter, the data driving control circuit 322 may change the configuration of the equalizer 410 according to the plurality of pieces of EQ configuration information for each of the plurality of time sections $T_{EQ_TEST_1}$ to $T_{EQ_TEST_N}$. Here, the data driving control circuit 322 may evaluate the reception performance of the first data driving communication circuit 324 for the EQ training signal by changing the configuration of the equalizer 410 for each time section.

In addition, the data driving control circuit 322 may select optimal EQ configuration information from among the plurality of pieces of EQ configuration information according to the evaluation result for each time section.

For example, if the EQ training signal includes the first time $T_{IDLE}$, the second time $T_{EQ_CT}$, and the third time $T_{EQ_T}$, and if the third time is divided into the first time section $T_{EQ_TEST_1}$ to the $N^{th}$ time section $T_{EQ_TEST_N}$, the first data driving communication circuit 324 may receive a blank signal H during the first time $T_{IDLE}$. The data driving control circuit 322 may maintain an idle state during the first time $T_{IDLE}$.

Thereafter, the first data driving communication circuit 324 may receive an EQ clock training signal EQCP during the second time $T_{EQ_CT}$, and may perform clock training for testing of the equalizer 410. Here, clock training may be performed by the clock recovery circuit 420.

In addition, the first data driving communication circuit 324 may receive an EQ test signal EQTP during the third time $T_{EQ_T}$.

Here, the data driving control circuit 322 may configure the equalizer 410 using first EQ configuration information among the plurality of pieces of EQ configuration information at the time at which the first time section $T_{EQ_TEST_1}$ starts.

In addition, the first data driving communication circuit 324 may receive an EQ test signal EQTP through the equalizer 410 configured using the first EQ configuration information during the first time section $T_{EQ_TEST_1}$, and may recover data from the EQ test signal EQTP. Here, data recovery may be performed by the byte aligning circuit 430 and the pixel aligning circuit 440.

In the case where the EQ test signal EQTP includes a PRBS pattern, the data driving control circuit 322 may check whether or not the PRBS pattern included in the recovered data for the first time section $T_{EQ_TEST_1}$ matches a previously stored bit stream, and may identify a bit error rate for the EQ test signal EQTP received during the first time section $T_{EQ_TEST_1}$ according thereto.

If the EQ test signal EQTP includes test data that is encoded in a DC balance code method, the data driving control circuit 322 may identify the number of "0"s and "1"s in the code group of the recovered data during the first time section $T_{EQ_TEST_1}$, and may identify whether or not there is a data error in the EQ test signal EQTP received during the first time section $T_{EQ_TEST_1}$ according thereto. Here, the DC balance code method may be an 8B10B encoding/decoding method.

The data driving control circuit 322 may evaluate the reception performance of the first data driving communication circuit 324 for the first EQ configuration information through the bit error rate of the EQ test signal or information on whether or not there is a data error therein as described above.

After the first time section $T_{EQ_TEST_1}$ elapses, the data driving control circuit 322 may configure the equalizer 410 using second EQ configuration information at the time at which the second time section $T_{EQ_TEST_2}$ starts.

In addition, the first data driving communication circuit 324 may receive an EQ test signal through the equalizer 410 configured using the second EQ configuration information during the second time section $T_{EQ_TEST_2}$, and may recover data from the EQ test signal EQTP.

In the case where the EQ test signal EQTP includes a PRBS pattern, the data driving control circuit 322 may check whether or not the PRBS pattern included in the recovered data for the second time section $T_{EQ_TEST_2}$ matches a previously stored bit stream, and may identify a bit error rate for the EQ test signal EQTP received during the second time section $T_{EQ_TEST_2}$ according thereto.

If the EQ test signal EQTP includes test data that is encoded in a DC balance code method, the data driving control circuit 322 may identify the number of "0"s and "1"s in the code group of the recovered data during the second time section $T_{EQ_TEST_2}$, and may identify whether or not there is a data error in the EQ test signal EQTP received during the second time section $T_{EQ_TEST_2}$ according thereto.

The data driving control circuit 322 may evaluate the reception performance of the first data driving communication circuit 324 for the second EQ configuration information through the bit error rate of the EQ test signal or information on whether or not there is a data error therein as described above.

The data driving control circuit 322 may evaluate the reception performance of the first data driving communication circuit 324 for each of the plurality of pieces of EQ configuration information by repeatedly performing the above process for the respective sections subdivided from the third time $T_{EQ_T}$.

In addition, the data driving control circuit 322 may select EQ configuration information enabling optimal reception performance, as optimal EQ configuration information, from among the plurality of pieces of EQ configuration information, and may complete the configuration of the equalizer 410 according to the optimal EQ configuration information.

The data driving device 120, having completed the configuration of the equalizer 410 according to the optimal EQ configuration information as described above, may perform communication (display mode) for receiving image data from the data processing device 140.

As described above, when power is applied to the display device 100, the data driving device 120 may evaluate the reception performance for the EQ training signal by changing the configuration of the equalizer 410 for each time section according to a plurality of pieces of EQ configuration information, and may configure the equalizer 410 using EQ configuration information enabling the optimal reception performance, among the plurality of pieces of EQ configuration information. Therefore, it is possible to automatically optimize the configuration of the equalizer 410 according to the signal distortion form of the main communication signal MLP, which changes depending on the characteristics of the first communication line LN1, when power is applied.

Meanwhile, in an embodiment, when the data processing device 140 and the data driving device 120 transmit and receive the second protocol signal PS2, the communication frequency of the second protocol signal PS2, that is, the communication frequency of low-speed data communication may be predetermined.

In addition, the clock recovery circuit 420, which is an internal circuit of the data driving device 120, may be configured to conform to the communication frequency of the second protocol signal PS2.

On the other hand, the communication frequency of the first protocol signal PS1, that is, the communication frequency of high-speed data communication, may not be predetermined.

Figure 7:
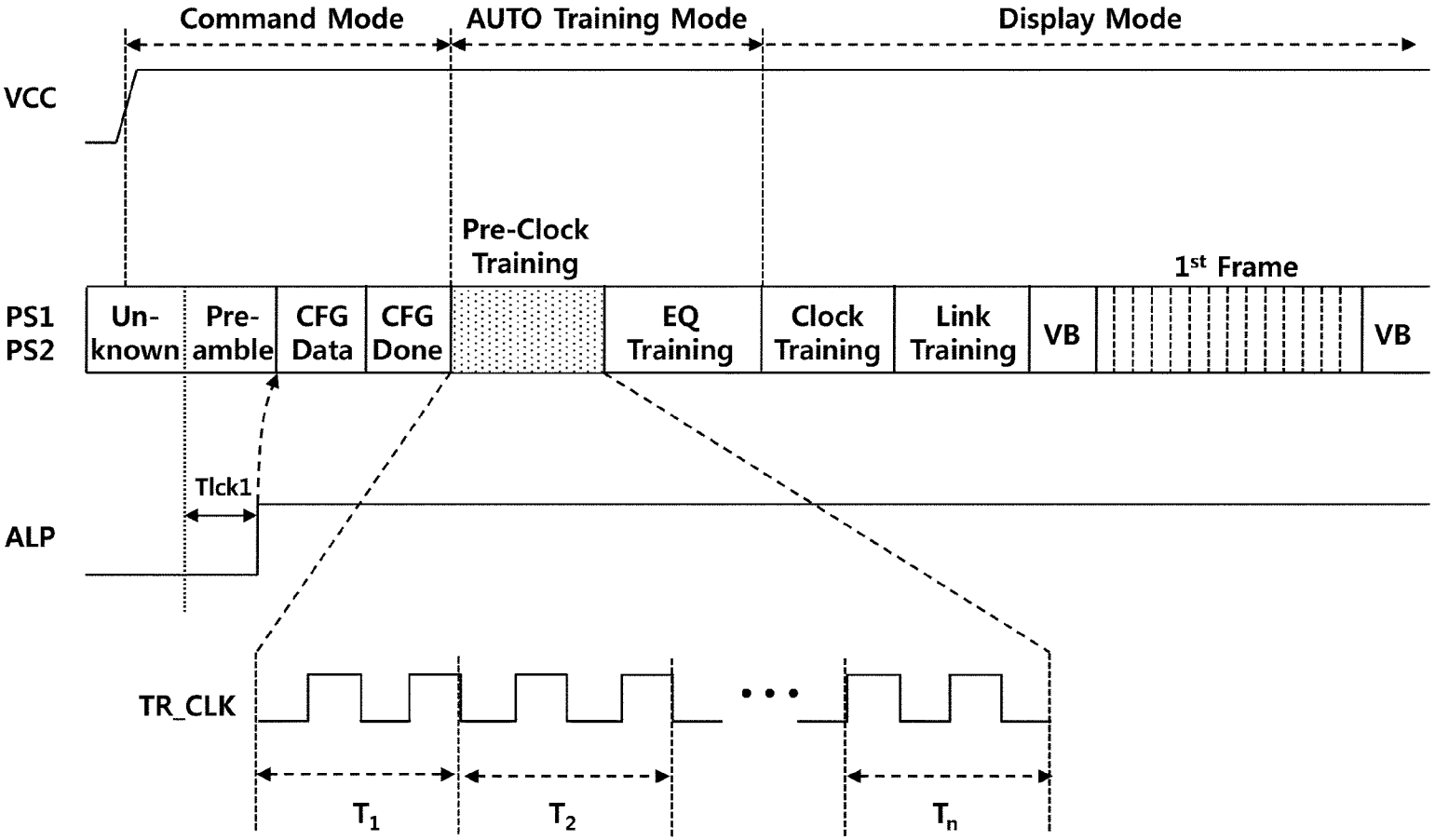
FIG. 7 is a diagram illustrating a signal sequence for further configuring a first data driving communication circuit according to an embodiment.

Therefore, the data processing device 140 and the data driving device 120 may configure the internal circuit so as to conform to the communication frequency of the first protocol signal PS1 through a pre-clock training section shown in FIG. 7 before transmitting and receiving the EQ training signal, which is a first protocol signal PS1.

Specifically, the data processing device 140 may transmit a first protocol signal PS1 including a training clock pattern TR_CLK to the data driving device 120 during the pre-clock training section. Hereinafter, the first protocol signal PS1 transmitted to the data driving device 120 during the pre-clock training section will be referred to as a "communication signal".

The data driving device 120 may subdivide the pre-clock training section into a plurality of time sections (e.g., $T_1$ to $T_n$, in FIG. 7), and perform training for the training clock pattern TR_CLK included in the communication signal by changing a configuration value of an oscillator (not shown) included in the clock recovery circuit 420 for each of the subdivided time sections.

In addition, the data driving device 120 may select an optimal configuration value according to the training result for the training clock pattern TR_CLK, and may configure the oscillator (not shown) using the optimal configuration value. The configuration value of the oscillator (not shown)

may include any one of a reference current value, a reference voltage value, and a gain of the oscillator (not shown).

Here, the oscillator (not shown) is a circuit of which the characteristics are changed depending on the communication frequency, and if any one of the reference current, the reference voltage, and the gain of the oscillator (not shown) changes, the frequency of an oscillation signal output from the oscillator (not shown) may also change.

This oscillation signal may be used for training of the training clock pattern TR_CLK.

Accordingly, in an embodiment, the oscillator (not shown) may be configured using an optimal configuration value through the configuration described above, so the clock recovery circuit 420 may operate so as to conform to the communication frequency of the first protocol signal PS1.

Hereinafter, a process of configuring the equalizer 410 in the data driving device 120 will be described.

Figure 8:
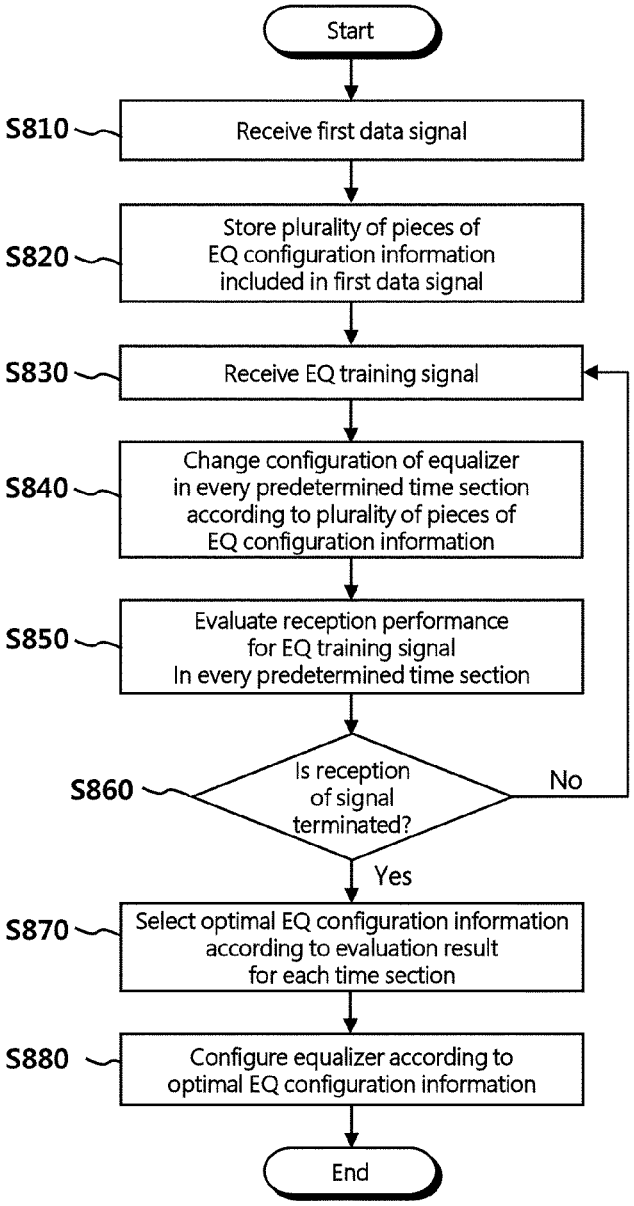
FIG. 8 is a flowchart illustrating a process of configuring an equalizer in a data driving device according to an embodiment.

FIG. 8 is a flowchart illustrating a process of configuring an equalizer in a data driving device according to an embodiment.

Referring to FIG. 8, when a driving voltage VCC is supplied to the data processing device 140 and the data driving device 120, the data driving device 120 may receive, from the data processing device 140, a first data signal, which is a second protocol signal PS2, including a plurality of pieces of EQ configuration information (S810). Here, the plurality of pieces of EQ configuration information may include gain levels of the equalizer 410, which are different from each other, and the first data signal may be transmitted through the first communication line LN1. In addition, the first data signal may further include information on the number of pieces of EQ configuration information.

The data driving device 120 may store the plurality of pieces of EQ configuration information included in the first data signal (S820).

Thereafter, the data driving device 120 may receive an EQ training signal, which is a first protocol signal PS1, from the data processing device 140 (S830). Here, the EQ training signal may include a training sequence that is repeated every time section as shown in FIG. 5, and the training sequence may be configured as a blank signal H having a predetermined level (e.g., a high level), an EQ clock training signal EQCP disposed at the end of the blank signal, and an EQ test signal EQTP disposed at the end of the EQ clock training signal EQCP.

In addition, the EQ training signal may be configured as a blank signal H having a predetermined level (e.g., a high level), an EQ clock training signal EQCP disposed at the end of the blank signal H, and an EQ test signal EQTP disposed at the end of the EQ clock training signal EQCP as shown in FIG. 6.

The data driving device 120 may change the configuration of the equalizer 410 every predetermined time section according to the plurality of pieces of EQ configuration information, and may evaluate the reception performance for the EQ training signal every predetermined time section (S840 and S850). Here, in the case where the EQ training signal includes a training sequence, the data driving device 120 may change the configuration of the equalizer 410 at or after the time at which the EQ training signal is initially received.

In addition, in the case where the EQ training signal includes one blank signal H, one EQ clock training signal EQCP, and one EQ test signal EQTP, the data driving device 120 may change the configuration of the equalizer 410 at or after the time at which the EQ test signal EQTP is received.

The data driving device 120 may repeat the steps S840 and S850 until the reception of the EQ training signal is terminated (S860).

When the reception of the EQ training signal is terminated, the data driving device 120 may select optimal EQ configuration information from among the plurality of pieces of EQ configuration information according to the evaluation result for each time section (S870).

Thereafter, the data driving device 120 may configure the equalizer using the optimal EQ configuration information (S880). According to this, the data driving device 120 may appropriately offset the signal distortion of the main communication signal MLP transmitted through the first communication line LN1.

What is claimed is:

1. A data driving device comprising:

a communication circuit comprising an equalizer and configured to receive a first data signal containing a plurality of pieces of equalizer (EQ) configuration information for configuring the equalizer and then to receive an EQ training signal during a plurality of time sections; and a control circuit configured to evaluate reception performance for the EQ training signal of the communication circuit in each of the plurality of time sections by changing a configuration of the equalizer in every time section according to each piece of EQ configuration information and select optimal EQ configuration information according to a result of the evaluation, wherein each of the plurality of pieces of EQ configuration information comprises a gain level of the equalizer and the control circuit differently sets the gain level of the equalizer in each time section according to each piece of EQ configuration information.

2. The data driving device of claim 1, wherein the first data signal further comprises information on the number of pieces of EQ configuration information, and the control circuit identifies the number of time sections through the information on the number of pieces of EQ configuration information.

3. The data driving device of claim 1, wherein the communication circuit receives a first data signal through a low-speed data communication protocol and receives the EQ training signal through a high-speed data communication protocol, which is different from the low-speed data communication protocol.

4. The data driving device of claim 1, wherein the EQ training signal comprises a training sequence that is repeated in every time section, and the training sequence comprises a blank signal for distinguishing the respective time sections from each other, an EQ clock training signal disposed at the end of the blank signal, and an EQ test signal disposed at the end of the EQ clock training signal.

5. The data driving device of claim 4, wherein, in a blank signal reception section of one training sequence, the communication circuit initializes a clock trained in a training sequence prior to the one training sequence, and, in an EQ clock training signal reception section of the one training sequence, the communication circuit re-performs a clock training.

6. The data driving device of claim 5, wherein the first data signal and the EQ training signal are transmitted from a data processing device and a level of a lock signal transmitted from the data driving device to the data processing device is maintained to be constant when initializing the clock and re-performing the clock training.

7. The data driving device of claim 4, wherein the EQ test signal comprises a pseudo random binary sequence (PRBS) pattern and the control circuit calculates a bit error rate for the PRBS pattern in each time section and selects EQ configuration information, corresponding to a time section having the minimum bit error rate among the plurality of time sections, as optimal EQ configuration information.

8. The data driving device of claim 4, wherein the EQ test signal comprises test data encoded in a DC balance code method and the control circuit checks whether there is any error in the test data in each time section and selects EQ configuration information, corresponding to a time section having the minimum number of errors in the test data among the plurality of time sections, as the optimal EQ configuration information.

9. The data driving device of claim 4, wherein the control circuit changes the configuration of the equalizer when the communication circuit receives the blank signal.

10. The data driving device of claim 4, wherein, if a signal having a predetermined voltage level is received for a predetermined time or longer, the communication circuit initializes a clock and the blank signal is maintained at a constant voltage level for a predetermined time.

11. A data driving device comprising:

a communication circuit comprising an equalizer and configured to receive a first data signal containing a plurality of pieces of equalizer (EQ) configuration information for configuring the equalizer and then to receive an EQ training signal comprising a blank signal having a predetermined level, an EQ clock training signal disposed at the end of the blank signal, and an EQ test signal disposed at the end of the EQ clock training signal; and a control circuit configured to divide reception time of the EQ test signal into a plurality of time sections, when the communication circuit receives the EQ test signal, to evaluate reception performance for the EQ training signal of the communication circuit in each of the plurality of time sections by changing a configuration of the equalizer in each time section according to each piece of EQ configuration information, and to select optimal EQ configuration information according to a result of the evaluation.

12. The data driving device of claim 11, wherein the first data signal further comprises information on the number of pieces of EQ configuration information, and wherein the control circuit determines the number of time sections to conform to the number of pieces of EQ configuration information.

13. The data driving device of claim 11, wherein each of the plurality of pieces of EQ configuration information comprises a gain level of the equalizer and the control circuit differently sets the gain level of the equalizer in each time section according to each piece of EQ configuration information.

14. A data driving system comprising:

a data processing device configured to generate a first data signal comprising a plurality of pieces of equalizer (EQ) configuration information, which is configuration information of an equalizer to transmit the first data signal, to generate an EQ training signal, and to transmit the EQ training signal during a plurality of time sections; and a data driving device comprising the equalizer and configured to receive the EQ training signal during the plurality of time sections after receiving the first data signal, to evaluate reception performance for the EQ training signal by changing a configuration of the equalizer in each of the plurality of time sections according to each piece of EQ configuration information, to select optimal EQ configuration information according to a result of the evaluation, and then, to configure the equalizer according to the optimal EQ configuration information, wherein each of the plurality of pieces of EQ configuration information comprises a gain level of the equalizer and the data driving device differently sets the gain level of the equalizer in each time section according to each piece of EQ configuration information.

15. The data driving system of claim 14, wherein the data processing device transmits a first data signal to the data driving device through a low-speed data communication protocol and transmits the EQ training signal to the data driving device through a high-speed data communication protocol, which is different from the low-speed data communication protocol.

16. The data driving system of claim 15, wherein the data processing device transmits a communication signal, having a communication frequency corresponding to the high-speed data communication protocol, to the data driving device before transmitting the EQ training signal and the data driving device receives the communication signal, trains a clock included in the communication signal by changing a configuration value of an oscillator included in an internal circuit every predetermined time, and determines an optimal configuration value for the communication frequency according to a result of training the clock.

17. The data driving system of claim 16, wherein the configuration value comprises any one of a reference current value, a reference voltage value, and a gain of the oscillator.

18. The data driving system of claim 14, wherein the EQ training signal comprises a training sequence that is repeated in each time section, wherein the training sequence comprises a blank signal for distinguishing the respective time sections from each other, an EQ clock training signal disposed at the end of the blank signal, and an EQ test signal disposed at the end of the EQ clock training signal, and, in a blank signal reception section of one training sequence, the data driving device initializes a clock trained in a training sequence prior to the one training sequence, and, in an EQ clock training signal reception section of the one training sequence, the data driving device re-performs a clock training.

19. The data driving system of claim 14, wherein the data driving device initializes a clock if a signal having a predetermined voltage level is received for a predetermined time or longer.

20. The data driving system of claim 19, wherein the data driving device receives a signal having a predetermined voltage level for a predetermined time or longer in each time section to initialize a clock.

* * * * *